United States Patent [19]

Satterness et al.

[11] Patent Number: 4,748,818

[45] Date of Patent: Jun. 7, 1988

[54] TRANSPORT REFRIGERATION SYSTEM HAVING MEANS FOR ENHANCING THE CAPACITY OF A HEATING CYCLE

[75] Inventors: Cynthia J. Satterness, Bloomington; Donald J. Bongaards, Minneapolis, both of Minn.

[73] Assignee: Thermo King Corporation, Minneapolis, Minn.

[21] Appl. No.: 61,767

[22] Filed: Jun. 15, 1987

[51] Int. Cl.[4] ..... F25B 13/00

[52] U.S. Cl. ..... 62/160; 62/197; 62/278; 62/503; 62/509

[58] Field of Search ..... 62/197, 196.4, 278, 62/81, 503, 509, 160, 159, 174, 324.1, 324.4, 324.5, 324.6

[56] References Cited

U.S. PATENT DOCUMENTS

| | | | |
|---|---|---|---|
| 2,693,683 | 11/1954 | Toothman | 62/509 X |
| 2,878,654 | 3/1959 | Kramer | 62/278 |
| 3,095,710 | 7/1963 | Clark | 62/197 X |
| 3,219,102 | 11/1965 | Taylor | 165/2 |
| 4,122,688 | 10/1978 | Mochizuki et al. | 62/278 X |
| 4,325,224 | 4/1982 | Howland | 62/196.2 |
| 4,419,866 | 12/1983 | Howland | 62/228.4 |

*Primary Examiner*—Harry B. Tanner
*Attorney, Agent, or Firm*—D. R. Lackey

[57] ABSTRACT

A transport refrigeration system 10, and method of operating same, which includes a compressor 14, a receiver 26, an evaporator 42, an accumulator 44, and valve means 18 which initiates heating and cooling modes or cycles which utilize hot compressor gas. Instead of pressurizing receiver 26 at the start of a heating cycle, which traps refrigerant in condenser 24, the heating capacity of a heating cycle is enhanced by connecting the outlet of receiver 26 and the inlet of accumulator 44 in direct fluid flow communication during a heating cycle. Lower pressure in accumulator 44 allows liquid refrigerant in receiver 26 to be directed into accumulator 44, while permitting refrigerant in condenser 24 to drain into receiver 26, to make additional liquid refrigerant available during the heating cycle.

6 Claims, 1 Drawing Sheet

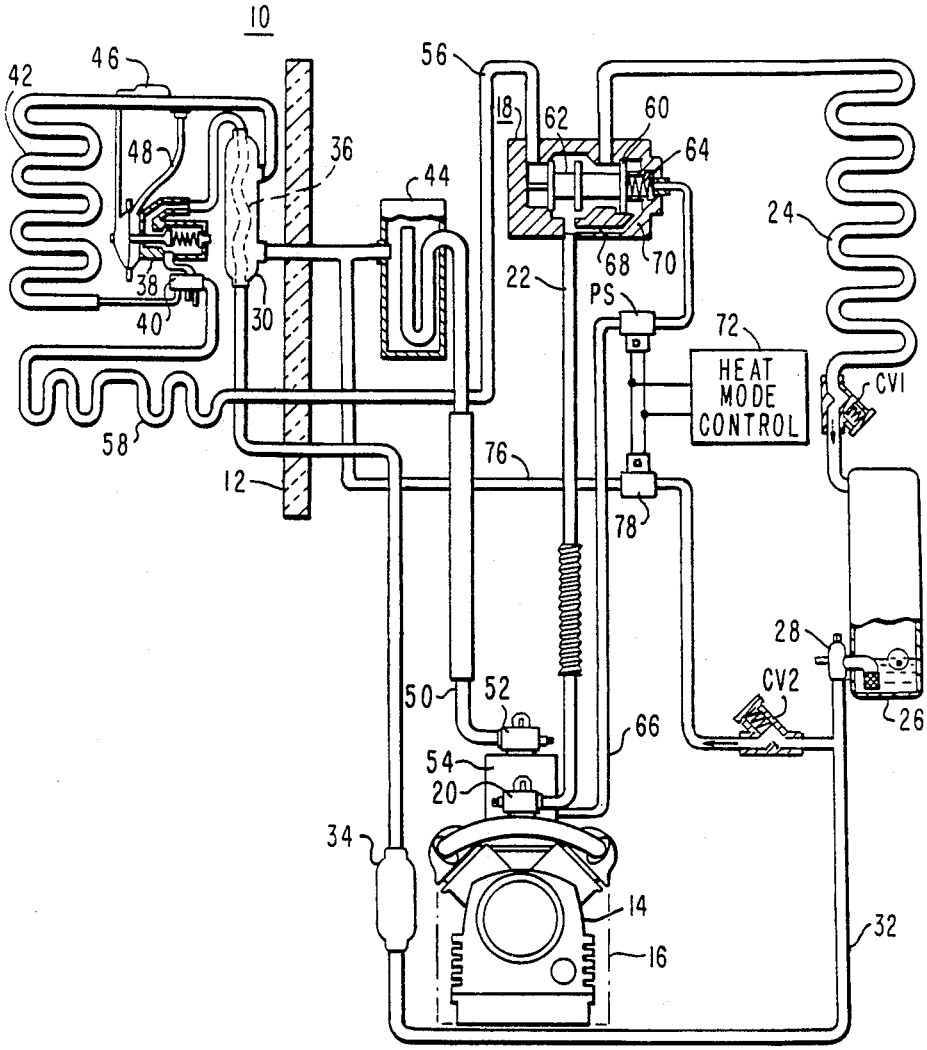
10
42
46
48
36
44
56
18
62
60
64
24
38
40
30
22
68
70
PS
72
HEAT
MODE
CONTROL
CVI
58
12
76
78
28
CV2
26
50
52
66
54
20
34
14
16
32

TRANSPORT REFRIGERATION SYSTEM HAVING MEANS FOR ENHANCING THE CAPACITY OF A HEATING CYCLE

BACKGROUND OF THE INVENTION

1. Field of the Invention:

The invention relates in general to transport refrigeration systems, and more specifically to such systems having heating and cooling cycles which utilize hot compressor discharge gas.

2. Description of the Prior Art:

Transport refrigeration systems for conditioning the loads of trucks and trailers have cooling, null and heating modes. The heating mode includes a heating cycle for controlling load temperature to a set point, as well as a heating cycle for defrosting the evaporator coil. When the system switches from a cooling or null mode into a heating cycle, hot compressor discharge gas is diverted by suitable valve means from the normal refrigerant circuit which includes a condenser, receiver, expansion valve, evaporator, and accumulator, to a circuit which includes the compressor, evaporator and accumulator.

To make more liquid refrigerant available during a heating cycle, the receiver is normally pressurized with the hot compressor discharge gas to force liquid refrigerant out of the receiver and into the refrigerant cooling circuit. A bleed port in the expansion valve allows this liquid to flow into the evaporator during the heating cycle, to improve heating or defrosting capacity.

SUMMARY OF THE INVENTION

Briefly, the present invention is a new and improved transport refrigeration system, and method of operating same, which connects the receiver and accumulator in direct fluid flow communication during a heating cycle, while eliminating the conventional pressurization of the receiver. Pressurization of the receiver, while forcing refrigerant out of the receiver, has the disadvantage of trapping liquid refrigerant in the condenser. The present invention establishes a flow path from the receiver outlet to the accumulator inlet during a heating cycle. This has the advantage of allowing the condenser to drain into the receiver, to increase the amount of liquid refrigerant available during the heating cycle. It has the additional advantage of injecting the liquid refrigerant from the receiver directly into the heating cycle circuit, instead of into the cooling cycle refrigeration circuit, and thus a bleed port on the expansion valve is not required. Liquid refrigerant in the receiver is forced into the accumulator due to the normal pressure differential which exists between the accumulator and receiver.

BRIEF DESCRIPTION OF THE DRAWING

The invention may be better understood and further advantages and uses thereof more readily apparent when considered in view of the following detailed description of exemplary embodiments, taken with the accompanying drawings, in which the single FIGURE illustrates a transport refrigeration system constructed according to the teachings of the invention.

DESCRIPTION OF PREFERRED EMBODIMENTS

U.S. Pat. Nos. 3,219,102; 4,325,224; and 4,419,866, which are assigned to the same assignee as the present application, describe transport refrigeration systems in detail, and they are hereby incorporated into the present application by reference so the following description may concentrate on the inventive aspects of a transport refrigeration system.

Referring now to the single FIGURE, there is shown a transport refrigeration system 10 constructed according to the teachings of the invention. Refrigeration system 10 is mounted on the front wall 12 of a truck or trailer. Refrigeration system 10 includes a closed fluid refrigeration circuit which includes a refrigerant compressor 14 driven by a prime mover, such as an internal combustion engine indicated generally by broken outline 16. Discharge ports of compressor 14 are connected to an inlet port of a three-way valve 18 via a discharge service valve 20 and a hot gas conduit or line 22. The functions of the three-way valve 18, which has heating and cooling positions, may be provided by separate valves, if desired.

One of the output ports of three-way valve 18 is connected to the inlet side of a condenser coil 24. This port is used the cooling position of three-way valve 18, and it connects compressor 14 in a first refrigerant circuit. The outlet side of condenser coil 24 is connected to the inlet side of a receiver tank 26 via a one-way condenser check valve CV1 which enables fluid flow only from the outlet side of condenser coil 24 to the inlet side of receiver tank 26. An outlet valve 28 on the outlet side of receiver tank 26 is connected to a heat exchanger 30 via a liquid conduit or line 32 which includes a dyhydrator 34.

Liquid refrigerant from liquid line 32 continues through a coil 36 in heat exchanger 30 to an expansion valve 38. The outlet of expansion valve 38 is connected to a distributor 40 which distributes refrigerant to inlets on the inlet side of an evaporator coil 42. The outlet side of evaporator coil 42 is connected to the inlet side of a closed accumulator tank 44 by way of heat exchanger 30. Expansion valve 38 is controlled by an expansion valve thermal bulb 46 and an equalizer line 48. Gaseous refrigerant in accumulator tank 44 is directed from the outlet side thereof to the suction port of compressor 14 via a suction line 50, a suction line service valve 52, and a suction throttling valve 54.

In the heating position of three-way valve 18, a hot gas line 56 extends from a second outlet port of three-way valve 18 to the inlet side of evaporator coil 42 via a defrost pan heater 58 located below evaporator coil 42. The conventional by-pass conduit or pressurizing tap, such as shown in FIG. 1 of the incorporated U.S. Pat. No. 4,419,386, which normally extends from hot gas line 56 to receiver tank 26 via by-pass and service check valves, is eliminated by the present invention, as is the need for a bleed port in expansion valve 38.

Three-way valve 18 includes a piston 60, a spool 62, and a spring 64. A conduit 66 connects the front or spring side of piston 60 to the intake side of compressor 14 via a normally closed pilot solenoid valve PS. When solenoid operated valve PS is closed, three-way valve 18 is spring biased to the cooling position, to direct hot, high pressure gas from compressor 14 to condenser coil 24. A bleed hole 68 in valve housing 70 allows pressure from compressor 14 to exert additional force against piston 60, to help maintain valve 18 in the cooling position. Condenser coil 24 removes heat from the gas and condenses the gas to a lower pressure liquid. When evaporator 42 requires defrosting, and also when a heating mode is required to hold the thermostat set point of the load being conditioned, pilot solenoid valve PS is opened via voltage provided by a control functions 72. Pressure on piston 60 thus dissipates to the low side of the system. Pressure on the back side of piston 60 then overcomes the pressure exerted by spring 64, and the assembly which includes piston 60 and spool 62 moves, operating three-way valve 18 to its heating position, in which flow of refrigerant to condenser 24 is sealed and flow to evaporator 42 is enabled. Suitable control 72 for operating solenoid valve PS is shown in the incorporated patents, such as the control in which the solenoid valve PS is identified with reference 26 in the incorporated U.S. Pat. No. 4,325,224.

The heating position of three-way valve 18 diverts the hot high pressure discharge gas from compressor 14 from the first or cooling mode refrigerant circuit into a second or heating mode refrigerant circuit which includes distributor 40, defrost pan heater 58, and the evaporator coil 42. Expansion valve 38 is by-passed during the heating mode. If the heating mode is a defrost cycle, an evaporator fan (not shown) is not operated. During a heating cycle required to hold a thermostat set point temperature, the evaporator fan is operated.

In addition to eliminating the conventional pressurizing tap from line 56 to receiver tank 26, the invention provides a new line of conduit 76 from the inlet side of accumulator 44 to the outlet side of receiver 26. Line 76 includes a normally closed solenoid valve 78 which is connected to be operated simultaneously with the operation of pilot solenoid PS. When pilot solenoid PS is energized to its open position, to initiate a heating cycle, solenoid valve 78 is simultaneously energized to its open position. In like manner, when pilot solenoid valve PS is deenergized to return to a cooling or null mode form a heating cycle, solenoid valve 78 is also deenergized to terminate the fluid flow communication between accumulator 44 and receiver 26 which existed during the heating cycle. A check valve CV2 is also provided in line 76, to prevent flow of refrigerant from accumulator 44 to receiver 26 in cold ambients.

Under normal operating conditions, when a heating cycle is initiated, signified by the opening of pilot solenoid valve PS and the opening of solenoid valve 78, the pressure in receiver 26 will be greater than the pressure in accumulator 44. Thus, liquid refrigerant in receiver 26 will be forced to flow to accumulator 44. Further, since there is no artificially imposed pressure in receiver 26, liquid refrigerant in condenser coil 24 will drain into receiver 26 and be forced to flow to accumulator 44. The invention thus forces the maximum amount of liquid refrigerant into the heating cycle, including refrigerant which is normally trapped in condenser 24, and it injects refrigerant directly into accumulator 44, instead of into evaporator 42 via a bleed port in expansion valve 38.

We claim as our invention:

1. In a transport refrigeration system, a refrigerant circuit which includes a compressor, condenser, receiver, evaporator, and accumulator, and mode selector valve means operable to select heating and cooling modes, wherein the accumulator is normally at a lower pressure than the receiver at the start of a heating mode, the improvement comprising:

control means for operating the mode selector valve means to initiate a heating mode, and means connecting the receiver and accumulator in direct fluid flow communication when the heating mode is initiated, to drain refrigerant from the condenser into the receiver, and to force refrigerant from the receiver into the accumulator, until the accumulator and receiver pressures are equalized, to enhance the heating capacity of the system.

2. The transport refrigeration system of claim 1 wherein the means which connects the receiver and accumulator in fluid flow communication when the heating mode is initiated includes piping having a controllable valve, and wherein the control means operates the controllable valve at the same time the mode selector valve means is operated to initiate a heating cycle.

3. The transport refrigeration system of claim 1 wherein the means which connects the receiver and accumulator in fluid flow communication when the heating mode is selected includes a check valve which permits fluid flow only from the receiver to the accumulator.

4. The transport refrigeration system of claim 1 wherein the refrigerant circuit is devoid of means for increasing the pressure in the receiver during the heating mode, to enable refrigerant in the condenser to drain into the receiver and make more refrigerant available during a heating mode.

5. A method of improving the heating capacity of a transport refrigeration system which has both heating and cooling modes, including a refrigerant circuit which includes a compressor, condenser, receiver, evaporator, and accumulator, and mode selector valve means operable to initiate a selected one of the heating and cooling modes, the steps of:

operating the mode selector valve means to select a heating mode, and connecting the receiver and accumulator in direct fluid flow communication when the heating mode is selected, to enable pressure differential between the receiver and accumulator to force refrigerant from the receiver to the accumulator while draining the condenser into the receiver.

6. The method of claim 5 including the step of preventing refrigerant from flowing directly from the accumulator to the receiver.

* * * * *